US012677954B2

(12) United States Patent
Tang et al.

(10) Patent No.: US 12,677,954 B2
(45) Date of Patent: Jul. 14, 2026

(54) FURNITURE ACCESSORY WITH ANNULAR CONTROL ARRAY

(71) Applicant: eMoMo Technology Co., Ltd., Shenzhen (CN)

(72) Inventors: Wenji Tang, Shenzhen City (CN); Mitchell Todd Carter, Ormond Beach, FL (US)

(73) Assignee: eMoMo Technology Co., Ltd., Shenzhen (CN)

( * ) Notice: Subject to any disclaimer, the term of this patent is extended or adjusted under 35 U.S.C. 154(b) by 212 days.

(21) Appl. No.: 18/436,741

(22) Filed: Feb. 8, 2024

(65) Prior Publication Data

US 2024/0260758 A1 Aug. 8, 2024

Related U.S. Application Data

(60) Provisional application No. 63/483,816, filed on Feb. 8, 2023.

(51) Int. Cl.
*A47C 7/62* (2006.01)

(52) U.S. Cl.
CPC ..... *A47C 7/622* (2018.08)

(58) Field of Classification Search
CPC ..... A47C 7/624; A47C 7/622
See application file for complete search history.

(56) References Cited

U.S. PATENT DOCUMENTS

| | | | | | |
|---|---|---|---|---|---|
| 5,072,989 | A * | 12/1991 | Spykerman | A47C 7/62 | 297/188.19 |
| 5,511,755 | A * | 4/1996 | Spykerman | B60N 3/101 | 220/575 |
| 5,634,621 | A * | 6/1997 | Jankovic | B60N 3/106 | 297/188.17 |
| 7,036,700 | B2 * | 5/2006 | Engel | B60N 3/106 | 224/544 |
| 7,766,293 | B2 | 8/2010 | Seidl et al. | | |
| 8,042,780 | B2 * | 10/2011 | Wagner | B60N 3/106 | 248/311.2 |
| 8,657,245 | B2 | 2/2014 | Stangl et al. | | |
| 8,714,505 | B1 | 5/2014 | Stangl et al. | | |
| 8,973,882 | B2 | 3/2015 | Stangl et al. | | |
| 9,089,221 | B2 | 7/2015 | Stangl et al. | | |
| 9,192,241 | B1 | 11/2015 | Seidl | | |
| 9,254,043 | B1 | 2/2016 | Seidl | | |
| 9,381,843 | B2 * | 7/2016 | Muiter | B60Q 3/229 | |
| 9,493,102 | B2 * | 11/2016 | Tang | F25B 21/02 | |
| 9,539,942 | B2 * | 1/2017 | Salter | B60Q 3/229 | |
| 9,585,486 | B2 | 3/2017 | Seidl | | |
| 9,867,471 | B2 | 1/2018 | Seidl | | |
| 10,051,968 | B2 | 8/2018 | Seidl | | |
| 10,299,603 | B2 | 5/2019 | Seidl | | |
| 10,537,182 | B2 | 1/2020 | Seidl | | |
| 10,806,265 | B2 | 10/2020 | Seidl | | |

(Continued)

*Primary Examiner* — Tye William Abell
(74) *Attorney, Agent, or Firm* — Womble Bond Dickinson (US) LLP

(57) ABSTRACT

A furniture accessory may include an outer body configured to connect to a furniture item, and a receptacle slidably supported in the outer body. The receptacle may be configured to receive a beverage container therein. The top end of the inner receptacle is axially spaced from and above the top end of the outer body when the inner receptacle is in each of a retracted and extended position.

20 Claims, 4 Drawing Sheets

(56) References Cited

U.S. PATENT DOCUMENTS

| | | | | |
|---|---|---|---|---|
| 11,089,701 | B1 | 8/2021 | Seidl | |
| 11,357,119 | B1 | 6/2022 | Seidl | |
| 11,778,758 | B2 | 10/2023 | Seidl | |
| 2006/0170257 | A1* | 8/2006 | Marshall | A47C 7/68<br>297/188.14 |
| 2022/0007521 | A1 | 1/2022 | Seidl | |
| 2023/0382589 | A1* | 11/2023 | Robertson | B65D 3/22 |

* cited by examiner

FURNITURE ACCESSORY WITH ANNULAR CONTROL ARRAY

CROSS-REFERENCE TO RELATED APPLICATIONS

This application claims the benefit of and priority to U.S. Provisional Patent Application No. 63/483,816 filed Feb. 8, 2023, the entire contents of which are incorporated herein by reference.

BACKGROUND OF THE DISCLOSURE

The present disclosure relates to furniture accessories. Specifically, the present disclosure relates to furniture accessories having a beverage holder and electrical features.

Over the years, developments in technology-enabled furniture have transformed the concept of a smart home into a practical reality. Furniture equipped with information transmission and control component technology continues to replace traditional furniture items that lack the technical functionality and aesthetic qualities that are desired in today's developing smart home.

BRIEF DESCRIPTION OF THE EXEMPLARY EMBODIMENTS

According to an aspect of this disclosure, an exemplary embodiment of a furniture accessory includes an outer body defining a central passage therethrough and having a top end and a bottom end. The furniture accessory further includes an inner receptacle, the inner receptacle extending within the central passage and having an opened top end positioned above the top end of the outer body, and an opened bottom end. The inner receptacle is configured to slide relative to the outer body between a retracted position and an extended position. The top end of the inner receptacle is axially spaced from and above the top end of the outer body when the inner receptacle is in each of the retracted and extended positions.

According to another aspect of this disclosure, an exemplary embodiment of a furniture accessory includes an outer body defining a cylindrically shaped central passage therethrough and having a top end and a bottom end. The furniture accessory further includes an inner receptacle, and the inner receptacle has an opened top end positioned above the top end of the outer body, an opened bottom end, and a cylindrical body extending within the central passage of the outer body. The inner receptacle is configured to slide relative to the outer body between a retracted position and an extended position. The top end of the inner receptacle is axially spaced from and above the top end of the outer body when the inner receptacle is in each of the retracted and extended positions.

According to another aspect of this disclosure, an exemplary embodiment of a furniture accessory includes an outer body defining a central passage therethrough and having a top end and a bottom end. The furniture accessory further includes an inner receptacle. The inner receptacle extends within the central passage and has an opened top end positioned above the top end of the outer body, and an opened bottom end. The inner receptacle is configured to slide relative to the outer body between a retracted position and an extended position. The furniture accessory further includes a collar supported on the outer body. The collar includes a control switch. The top end of the inner receptacle is axially spaced from and above the collar when the inner receptacle is in each of the retracted and extended positions.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
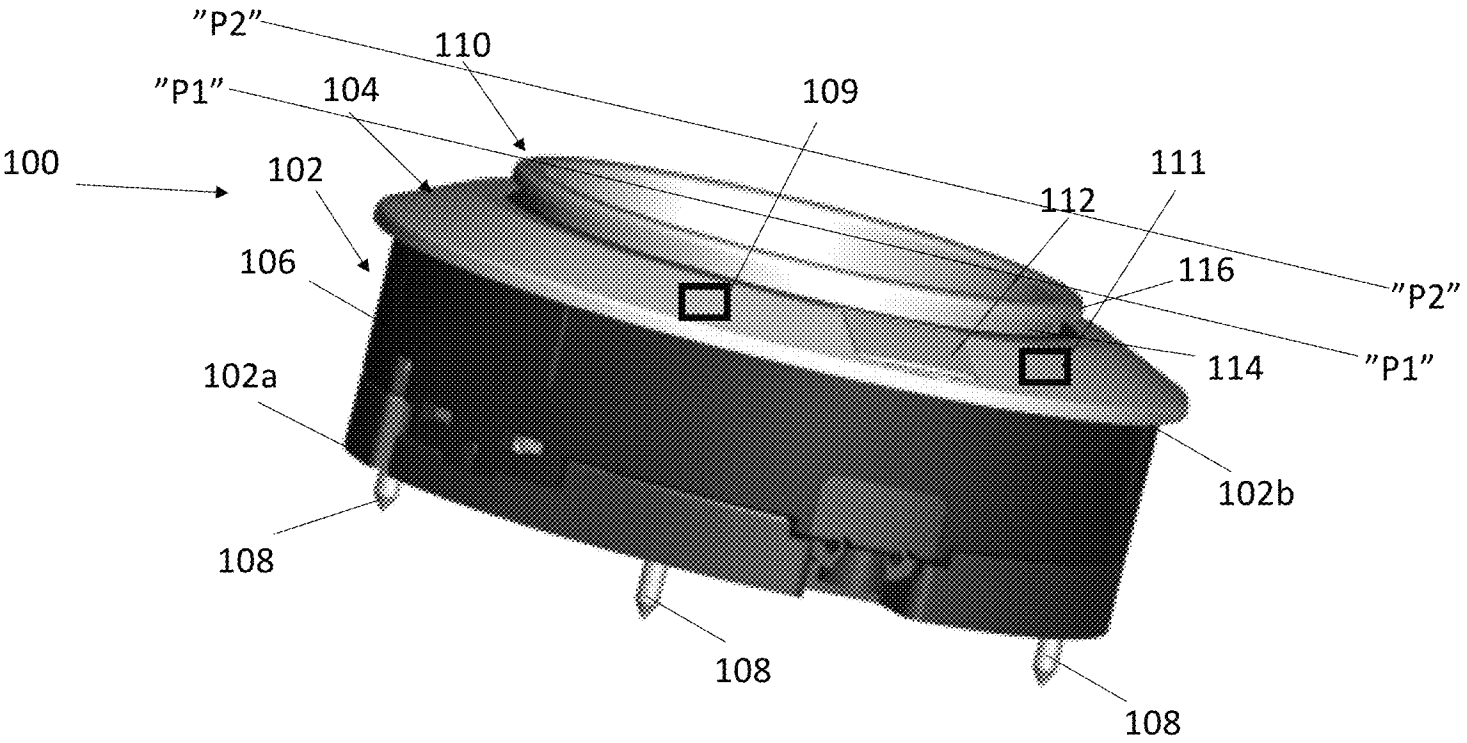
FIG. 1 is a perspective view of a furniture accessory, according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

For purposes of this disclosure, relative terms including, without limitation, "top", "bottom", "rear", "front", "upper", "lower", "above", "below", "within", and the like are used to aid the description of, e.g., configurations of features as shown in the accompanying figures, and otherwise as the disclosure makes clear. Such relative terms do not imply any particular dimension or delineation of or between features except where the disclosure makes clear.

For purposes of this disclosure, terms including, without limitation, "first", "second", "third" and "fourth" are used for descriptive purposes only and without limitation with respect to, e.g., an ordering of process steps, function, or configuration.

For purposes of illustrating features of the embodiments, an exemplary embodiment will now be introduced and referenced throughout the disclosure. It will be understood that this example and other exemplary embodiments described in this disclosure are illustrative and not limiting and are provided for illustrating the exemplary features of a furniture accessory equipped with a power supply.

With reference to FIG. 1, an exemplary embodiment of a furniture accessory 100 is provided. The furniture accessory 100 is a multifunctional cup holder configured to control various operations of the furniture accessory 100 itself and/or a furniture item (e.g., a couch, chair, or the like) to which the furniture accessory 100 is attached. The furniture accessory 100 generally includes an outer body 102, a collar 104 supported or formed integrally with, or joined to, the outer body 102, and an inner receptacle 110 supported within the outer body 102. The outer body 102 may have a cylindrical shape and includes an inner wall (not explicitly shown) and an outer wall 106 opposite the inner wall, between which electronic circuitry (not explicitly shown) may be provided.

A plurality of projections, such as, for example, screws or pins 108, extend downwardly from a bottom end 102*a* of the outer body 102 configured for penetrating and/or connecting to corresponding features formed in a portion of a furniture item (e.g., an armrest of a couch) to secure the furniture accessory 100 to the furniture item. The bottom end 102*a* of the outer body 102 may be open (i.e., devoid of a floor). As such, upon attaching the furniture accessory 100 to the portion of the furniture item (e.g., an armrest), the portion of the furniture item closes the bottom end 102*a* of the outer body 102 to form a floor of the furniture accessory 100. In other embodiments, the furniture accessory 100 may have a closed or partially closed bottom end 102*a*—for example, the bottom end 102*a* may include a bottom wall that extends across at least a portion of the central passage (not expressly shown or numbered).

The collar 104 of the furniture accessory 100 may be supported on and extend away from the central passage of the outer body 102. The collar 104 may be supported on and/or joined to the outer body 102 or may be formed integrally with the outer body 102. The collar 104 may have a frustoconical shape and may include one or more control buttons or switches 109, 111 arranged in an annular array about the inner receptacle 110. The control switches 109, 111 are in electrical communication with the electrical circuitry housed within the outer body 102 and are configured for controlling one or more other functions of the furniture accessory 100 and/or the furniture item to which the furniture accessory is attached. For example, and without limitation, control switches are disposed on the outer body for controlling a light associated with the furniture accessory and powering the furniture accessory on/off. Functions of the furniture item that can be actuated by control buttons disposed on the outer body may include, for example, recline, massage, and heating and cooling functions built into the furniture item.

The electrical circuitry or other electronic features of the furniture accessory 100 may be connected to, e.g., a plug (not shown) that extends out of the furniture item for providing power from a wall outlet. Alternatively, the furniture accessory and/or the furniture item may be connected to a battery power source.

The collar 104 may include a USB port (not explicitly shown) or other electrical connection for, e.g., connecting to and/or providing power to a smart phone or tablet, audio device, or the like, and/or receiving power from an external power source. The USB port or electrical connection may be covered by a hinged cover 112 as shown in FIG. 1.

Figure 2:
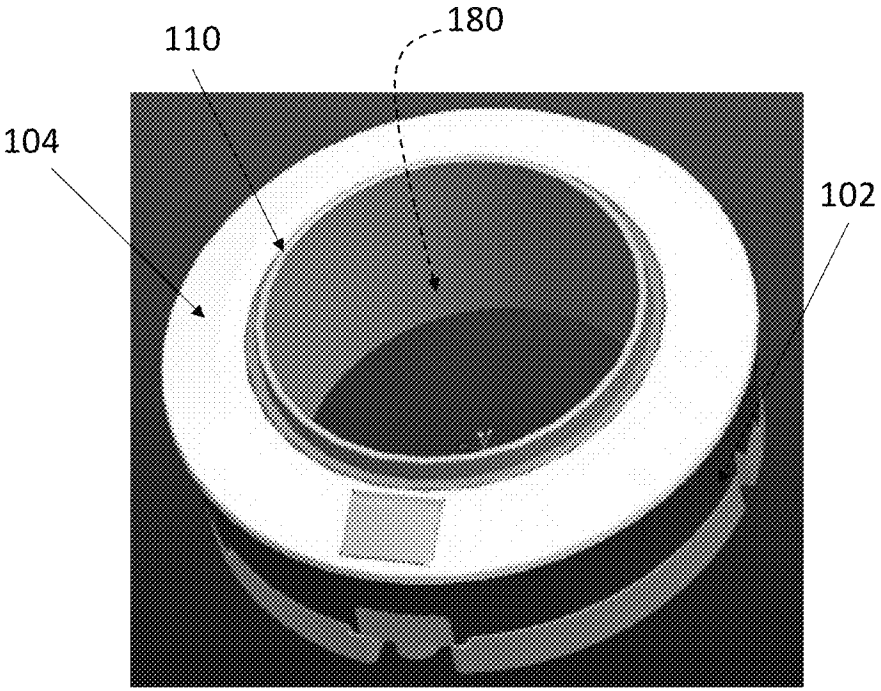
FIG. 2 is a top, perspective view of a smart furniture accessory, according to an exemplary embodiment.

With additional reference to FIG. 2, the receptacle 110 is received within a central passage 180 of the outer body 102 and includes a cylindrical wall 114 and may include a rim 116 extending from a top end of the cylindrical wall 114. In aspects, for example, the exemplary embodiment shown in FIG. 2, the receptacle 110 may be devoid of the rim 116. The rim 116 may overhang the collar 104 while being spaced axially above the collar 104. Due to the rim 116 of the receptable 110 overhanging the collar 104, the receptacle 110 is prevented from moving (discussed further below with respect to FIGS. 3-4B) to a position coplanar with or below the collar 104 or the top end 102*b* of the outer body 102. In aspects, the receptacle 110 may be preset in the retracted position shown in FIG. 1 with the rim 116 positioned above and spaced from the collar 104 and incapable of being retracted further from the retracted position.

Figure 4A:
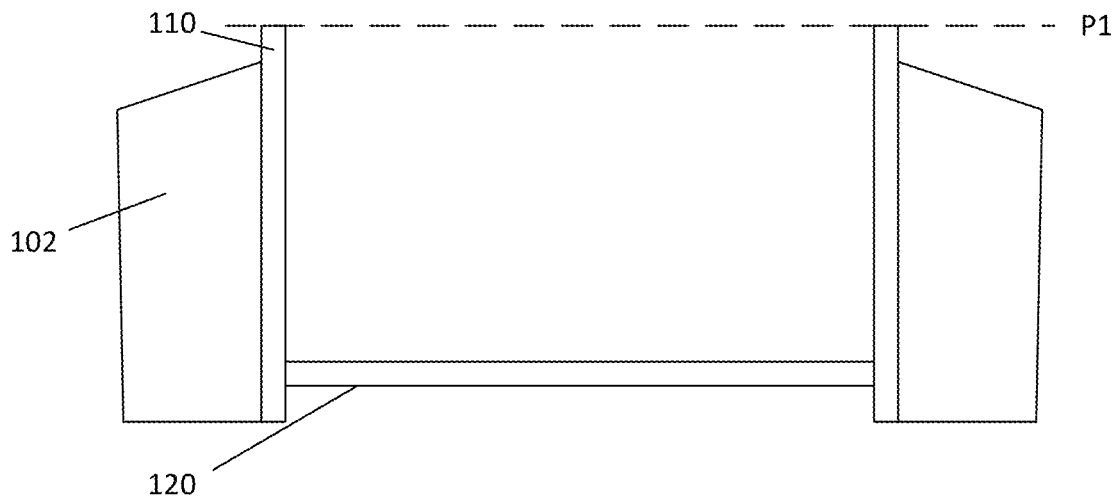
FIG. 4A is a cross-sectional schematic view of the furniture accessory with the receptacle in a retracted position.
Figure 4B:
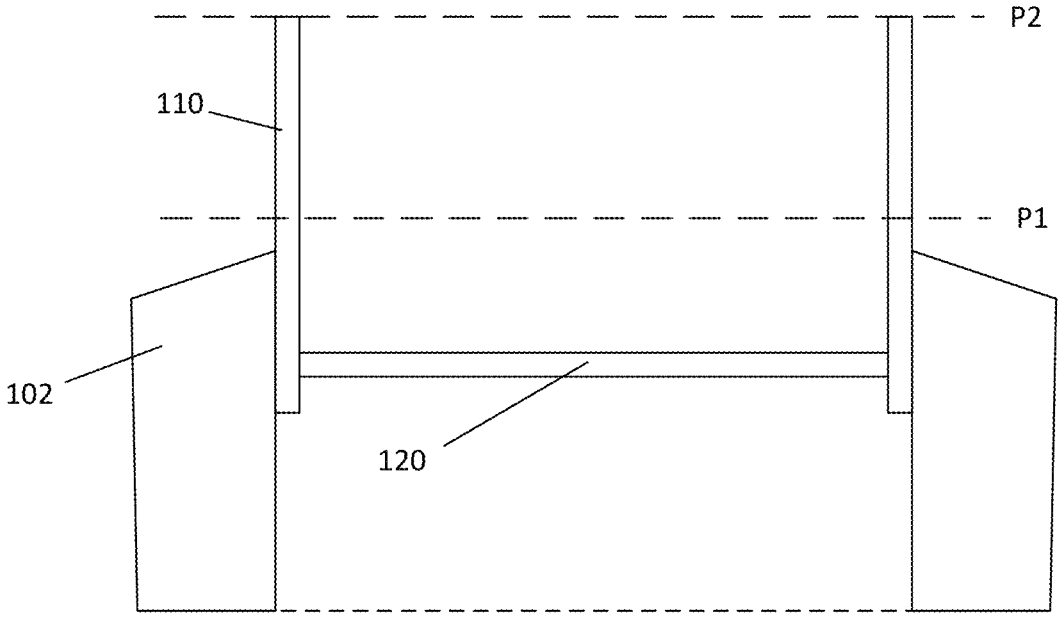
FIG. 4B is a cross-sectional schematic view of the furniture accessory with the receptacle in an extended position.

The cylindrical body 114 of the receptacle 110 is configured to receive and hold a beverage container (e.g., a cup) therein and prevent tipping of the beverage container. For example, the cylindrical body can have an inner diameter of about 7 cm (2.75 in) to about 10 cm (4 in). The cylindrical body can have an opened top end for receiving an object (e.g., a beverage container, a phone, etc.) as shown in FIG. 2. The cylindrical body 114 can also have an opened bottom end. The portion of the piece of furniture to which the furniture accessory 100 is attached, may form the floor or bottom of the opened bottom end of the cylindrical body 114, for preventing the beverage container from falling through the opened bottom of the receptacle 110. Alternatively, the bottom end of the cylindrical body 114 can have a bottom wall 120 that extends across at least a portion of the cylindrical body, as depicted in FIGS. 4A and 4B. The bottom wall may be part of, e.g., an acrylic insert (not shown) that fits within and is supported by the inner receptacle 110 to provide a bottom wall. In such a configuration, the bottom wall 120 of the cylindrical body can move with the inner receptacle 110 between the extended and retracted positions as shown in FIGS. 4A and 4B. FIGS. 4A and 4B also illustrate the elevation of the inner receptacle itself consistent with the exemplary embodiments discussed above. The cylindrical body of the receptacle 110 may have an axial length (e.g., a height) measured from a top end of the receptacle 110 to a bottom end of the receptacle 110 that is greater than a length (e.g., a height) of the outer body 102 measured between the top and bottom ends 102*a*, 102*b* thereof such that when the receptacle 110 is in the retracted position, the top end of the receptacle 110 extends above the collar 104, and therefore also the top end 102*b* of the outer body 102. In other embodiments, the length of the receptacle 110 may be less than a length of the outer body 102 but the receptacle 110 may be positioned within the central passage 180 such that the length of the receptacle 110 extends above the collar 104 and the top end 102*b* of the outer body 102 when in the fully retracted position.

Figure 3:
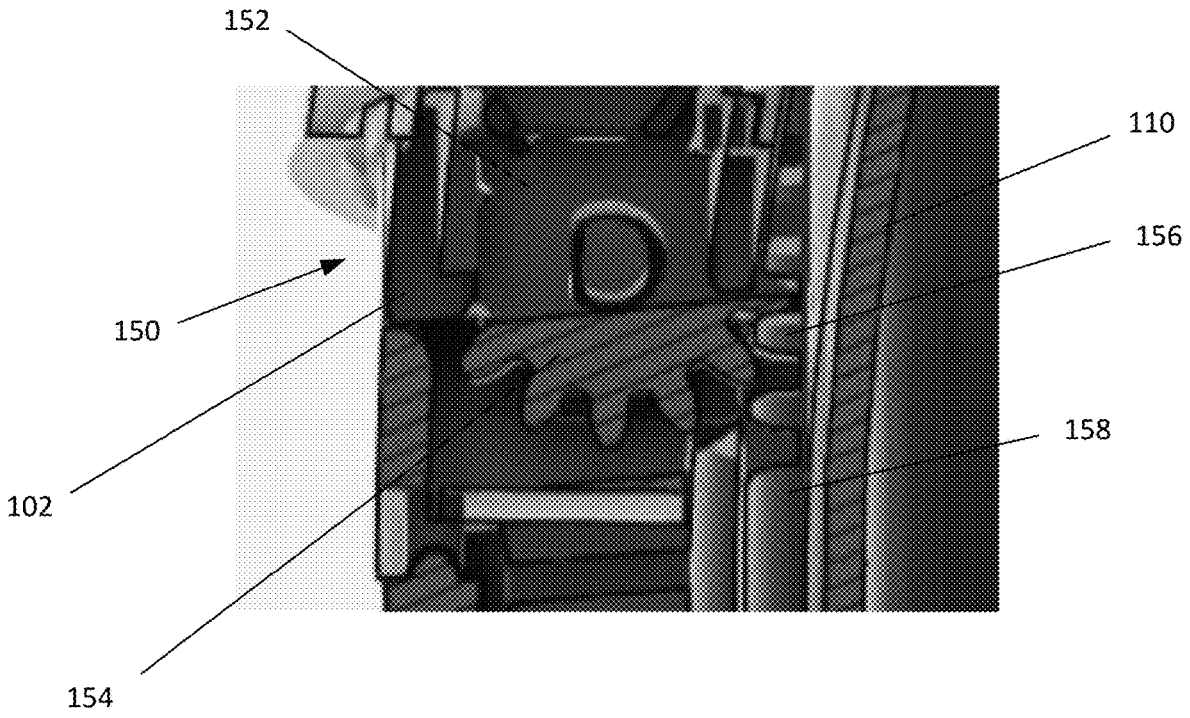
FIG. 3 is a cut-away view of a driving mechanism for a smart furniture accessory.

The furniture accessory 100 may further include a driving mechanism 150 configured to move or slide the receptacle 110 relative to the outer body 102 between retracted and extended positions. In an exemplary aspect shown in FIG. 3, the driving mechanism may include an electric motor 152, a gear 154 (e.g., a pinion gear) rotatably supported on the inner wall of the outer body 102 and operably coupled to the electric motor, and a linear rack 156 fixed to an outer surface of the cylindrical body 114 of the receptacle 110. The linear rack 156 is operably coupled to the gear 154 such that rotation of the gear drives a linear motion of the receptacle 110 between the extended and retracted positions. The motor may be programmed to stop the linear motion of the receptacle at predetermined positions (e.g., fully extend, fully retracted positions). Thus, activation of the motor can cause the receptacle to be moved to the extended or retracted positions substantially continuously. In an alternate aspect, the motor can be controlled by the user. In this alternate embodiment, the use can stop the movement of the receptacle at the fully retracted position, the fully extended position, or at any position between. The user may also be able to control the direction of movement of the receptacle by selecting either an extending movement or a retracting movement of the receptacle. In another aspect, the motor is absent and the user can manually extend or retract the receptacle by pulling or pushing on the cylindrical body of the receptacle. In this manual embodiment, the gear and linear rack, as shown in FIG. 3 can still be present to allow smooth movement of the receptacle. In any of the discussed embodiments for enabling movement of the receptacle, the linear rack can be used to stop the extension of the receptacle. For example, as shown in FIG. 3, the grooves of the linear rack terminate at bottom end 158 of the linear rack 156. When the linear rack reaches the end 158 of the linear rack 156, the extension of the receptacle is stopped. The end of the linear rack inhibits the receptacle from inadvertently being removed from the furniture accessory and defines the fully extended position of the receptacle. A top end (not shown) can also be formed on the linear rack. The top end of the linear rack defines the fully retracted position of the receptacle.

As described herein, the receptacle 110 can be extended between an extended position and a retracted position, as shown in FIGS. 4A and 4B. In the retracted position, as shown in FIG. 4A, the top end of the receptacle 110 is spaced axially above the outer body 102. In some aspects, the top end of the receptacle is spaced axially by about 10 cm, 20 cm, or 50 cm above the outer body in the fully retracted position. In the extended position (shown in FIG. 4B), the top end of the receptacle 110 is spaced axially above the outer body 102, whereby the furniture accessory 100 has a second overall length greater than the first overall length. In the retracted position, the top end of the receptacle 110 is coplanar with a first plane "P1," and in the extended position, the top end end of the receptacle 110 is coplanar with a second plane "P2," which is located above the first plane "P1" as depicted in FIGS. 1 and 4B. One of the control buttons (e.g., attached to the collar 104 or at another suitable location of the furniture accessory 100) may be configured to actuate the driving mechanism to move the receptacle between the retracted position and the extended position.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower", etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A furniture accessory, comprising:

an outer body defining a central passage therethrough and having a top end and a bottom end; and an inner receptacle extending within the central passage and having:

an opened top end positioned above the top end of the outer body;

an opened bottom end; and a cylindrical sidewall concentric with the central passage and extending between the opened top end and the opened bottom end;

wherein the inner receptacle is configured to slide relative to the outer body between a retracted position and an extended position, wherein the top end of the inner receptacle is axially spaced from and above the top end of the outer body when the inner receptacle is in each of the retracted and extended positions.

2. The furniture accessory of claim 1, wherein the inner receptacle has an axial length that is longer than an axial length of the central passage.

3. The furniture accessory of claim 1, further comprising one or more control switches disposed on the outer body, wherein the one or more control switches are in electrical communication with electrical circuitry housed within the outer body.

4. The furniture accessory of claim 1, further comprising a plurality of projections extending from a bottom end of the outer body.

5. The furniture accessory of claim 1, wherein the inner receptacle includes a linear rack coupled to an outer surface of the inner receptacle, and wherein the furniture accessory further includes a gear disposed in the outer body and coupled to the linear rack.

6. The furniture accessory of claim 5, wherein the gear is coupled to a motor, and wherein, during use, operation of the motor moves the inner receptacle between the retracted position and the extended position.

7. The furniture accessory according to claim 1, further comprising a collar supported on the top end of the outer body and surrounding the inner receptacle.

8. The furniture accessory according to claim 7, wherein the top end of the inner receptacle is axially spaced from and above a top end of the collar in both the retracted and extended positions.

9. The furniture accessory according to claim 7, wherein the collar includes a plurality of controls arranged in an annular array about the inner receptacle.

10. The furniture accessory according to claim 7, wherein the central passageway is cylindrical, and wherein the inner receptacle includes a cylindrical body extending within the central passage of the outer body.

11. The furniture accessory of claim 10, further comprising a rim extending from the cylindrical body, wherein the rim is positioned above and axially spaced from the collar when the inner receptacle is in each of the retracted and extended positions.

12. The furniture accessory of claim 10, wherein the cylindrical body has an inner diameter of 7 cm (2.75 in) to 10 cm (4 in).

13. A furniture accessory, comprising:

an outer body defining a cylindrically shaped central passage therethrough and having a top end and a bottom end; and an inner receptacle including:

an opened top end positioned above the top end of the outer body;

an opened bottom end;

and a cylindrical body extending within the central passage of the outer body between the opened top end and the opened bottom end, the inner receptacle being configured to slide relative to the outer body between a retracted position and an extended position, wherein the top end of the inner receptacle is axially spaced from and above the top end of the outer body when the inner receptacle is in each of the retracted and extended positions.

14. The furniture accessory according to claim 13, further comprising a collar supported on the top end of the outer body and surrounding the inner receptacle.

15. The furniture accessory according to claim 14, wherein the top end of the inner receptacle is axially spaced from and above a top end of the collar in both the retracted and extended positions.

16. The furniture accessory according to claim 14, wherein the collar includes a plurality of controls arranged in an annular array about the inner receptacle.

17. A furniture accessory, comprising:

an outer body defining a central passage therethrough and having a top end and a bottom end; and an inner receptacle extending within the central passage and having:

an opened top end positioned above the top end of the outer body;

an opened bottom end; and a cylindrical sidewall concentric with the central passage and extending between the opened top end and the opened bottom end;

wherein the inner receptacle is configured to slide relative to the outer body between a retracted position and an extended position, a collar supported on the outer body and including a control switch, wherein the top end of the inner receptacle is axially spaced from and above the collar when the inner receptacle is in each of the retracted and extended positions.

18. The furniture accessory of claim 17, wherein the control switch is in electrical communication with electrical circuitry housed within the outer body.

19. The furniture accessory according to claim 17, wherein the collar surrounds the inner receptacle.

20. The furniture accessory according to claim 19, wherein the top end of the inner receptacle is axially spaced from and above the top end of the outer body in both the retracted and extended positions.

* * * * *